US009803483B2

(12) United States Patent
Hunziker et al.

(10) Patent No.: US 9,803,483 B2
(45) Date of Patent: Oct. 31, 2017

(54) ROTOR BLADE WITH EDGE PROTECTION

(71) Applicant: ALSTOM Technology Ltd, Baden (CH)

(72) Inventors: Rolf Hunziker, Dintikon (CH); Krzysztof Cherek, Wettingen (CH); Sigurd Kubel, Ehrendingen (CH)

(73) Assignee: General Electric Technology GmbH, Baden (CH)

( * ) Notice: Subject to any disclaimer, the term of this patent is extended or adjusted under 35 U.S.C. 154(b) by 196 days.

(21) Appl. No.: 14/925,059

(22) Filed: Oct. 28, 2015

(65) Prior Publication Data

US 2016/0123158 A1 May 5, 2016

(30) Foreign Application Priority Data

Oct. 29, 2014 (EP) ..... 14190777

(51) Int. Cl.
*F01D 5/28* (2006.01)
*F01D 5/14* (2006.01)

(52) U.S. Cl.
CPC ..... *F01D 5/28* (2013.01); *F01D 5/147* (2013.01); *F01D 5/282* (2013.01); *F01D 5/286* (2013.01); *F05D 2250/38* (2013.01)

(58) Field of Classification Search
CPC . F01D 5/28; F01D 5/147; F01D 5/282; F01D 5/286; F05D 2250/38
USPC ..... 416/224
See application file for complete search history.

(56) References Cited

U.S. PATENT DOCUMENTS

| | | | | |
|---|---|---|---|---|
| 4,795,313 | A | 1/1989 | Coulon | |
| 5,782,607 | A | 7/1998 | Smith et al. | |
| 6,447,254 | B1 | 9/2002 | Holowczak et al. | |
| 7,896,221 | B2 | 3/2011 | Wallis | |
| 8,632,313 | B2 * | 1/2014 | Asai | C21D 1/10 416/223 R |
| 2012/0255176 | A1 | 10/2012 | Flesch et al. | |
| 2014/0013599 | A1 | 1/2014 | Guo | |

FOREIGN PATENT DOCUMENTS

| | | | |
|---|---|---|---|
| EP | 2 348 192 | A2 | 7/2011 |
| EP | 2 362 066 | A2 | 8/2011 |
| EP | 2 469 025 | A2 | 6/2012 |
| JP | S62 63101 | A | 3/1987 |

* cited by examiner

*Primary Examiner* — Richard Edgar
(74) *Attorney, Agent, or Firm* — GE Global Patent Operation; Cynthia W. Flanigan

(57) ABSTRACT

The invention relates to sheath for a blade that has a uniform assembly direction over the radial height of the sheath whether the blade has a straight or curved trajectory. This is achieved by the a sheath formed around the edge, having a first inner surface wherein a first tangential vector projected tangentially to the first inner surface in a direction away from the head portion in an longitudinal plain forms a first angle with the rotational axis that does not vary over the radial height of the sheath while a second tangential vector projected tangentially from any point of the second inner surface of the sheath in a direction towards the head portion intersects the first tangential vector.

6 Claims, 3 Drawing Sheets

ROTOR BLADE WITH EDGE PROTECTION

CROSS-REFERENCE TO RELATED APPLICATIONS

This application claims priority to European Patent Application 14190777.4 filed Oct. 29, 2014, the contents of which are hereby incorporated in its entirety.

TECHNICAL FIELD

The present disclosure relates in general to the configuration of rotor blade edge protection, including such edge protection applied to composite material blades and more specifically to protection for three dimensionally formed leading and trailing blade edges.

BACKGROUND

In steam turbines, leading edges of rotating blades may be exposed to water droplets, which make them prone to impact erosion, especially when the blade is made of materials such as composites. For this reason it is known to cover edges with material to increase erosion resistance. For example, U.S. Pat. No. 7,896,221 B2 discusses a manufacturing method that provides a portion of a blade aerofoil with increased erosion resistance. This is achieved by the use of titanium elements and a beta-stabilizing material. The titanium elements and the beta-stabilizing material are assembled such that the beta-stabilizing material is adjacent to the titanium elements. When heated the beta-stabilizing material diffuses into an adjacent portion of the titanium elements causing the adjacent portion of the one or more elements to have a beta microstructure which provides an increased erosion resistance. This solution requires the assembly of multiple elements in order to from an erosion resistance blade edge.

U.S. Pat. No. 5,782,607 discusses a further method that involves using replaceable ceramic insert that forms part of a protective sheath of a leading edge of a propeller blade providing a protective sheath. In order to facilitate maintenance and repair of the protective sheath, the sheath is held in place by a securing means such as adhesive, a screw or a pin.

In particularly for turbines blades that have edges curved in the circumferential direction, these solutions require the edge sheaths to be made of numerous smaller pieces bonded together.

SUMMARY

Provided is a blade a sheath fitted to a curved edge wherein the sheath is configured to overcome the problem of how to fit an inflexible sheath as a single piece to a curved edge of the blade.

The disclosure attempts to address this problem by means of the subject matter of the independent claim. Advantageous embodiments are given in the dependent claims.

The disclosure is based on the general idea of providing a solid leading edge or trailing edge to a blade having a core body that may be made of carbon fiber reinforced polymer or other material susceptible to erosion. A feature of the leading/training edge mount is its geometry with respect to the inner shape of the interface between the leading/trailing edge and the core body. The geometry is such that the sheath has a uniform assembly direction over the radial height of the sheath, which can be a straight or curved trajectory. This is achieved by the sheath covering a part of the core to form either a leading or trailing edge being configured such that despite the curvature of the covering edge, the sheath has a fixed assembly angle on the core.

The advantage of this configuration is that it enables one piece to be mounted onto the blade core result in a lower risk of lost parts, higher manufacturing accuracy and reliability of the interface strength as well as improved ease of assembly that enables the use of a guide tool thus allowing mounting along a straight line One general aspect includes a rotating blade having a rotational axis around which the blade rotates and first and second surfaces. The blade also includes an edge, defined by a junction, in a radial direction, of the first surface and the second surface, wherein the edge is curved in a circumferential direction. A sheath formed around the edge has a radial height between radial distal ends of the sheath and further has a head section that covers the edge of the blade. The radial height of the sheath may extend either over a fully radial height of the edge of the blade or a partial radial height of the edge of the blade. A first portion that projects from the head section along the first surface of the rotating blade has a first inner surface that, as viewed from a circumferential section defined as a section taken at a fixed distance from the rotational axis, is essentially straight at any point of the radial height, and a first tangential vector projected tangentially to the first inner surface in a direction away from the head section in a longitudinal plain so as to form a first angle with the rotational axis that does not vary over the radial height. A second portion, projecting from the head section along the second surface of the rotating blade, comprises a second inner surface, wherein a second tangential vector projected tangentially from any point of the second inner diverges from the first tangential vector in the direction of extension of the second portion from the head portion.

Further aspects may include one or more of the following features. The first inner surface, as viewed in a circumferential section, is essential straight at any point of the radial height. The rotating blade edge is a leading edge. The first surface is a pressure surface of the blade and the second surface is a suction surface of the blade.

It is a further object of the invention to overcome or at least ameliorate the disadvantages and shortcomings of the prior art or provide a useful alternative.

Other aspects and advantages of the present disclosure will become apparent from the following description, taken in connection with the accompanying drawings which by way of example illustrate exemplary embodiments of the present invention

BRIEF DESCRIPTION OF THE DRAWINGS

By way of example, an embodiment of the present disclosure is described more fully hereinafter with reference to the accompanying drawings, in which.

DETAILED DESCRIPTION

Figure 1:
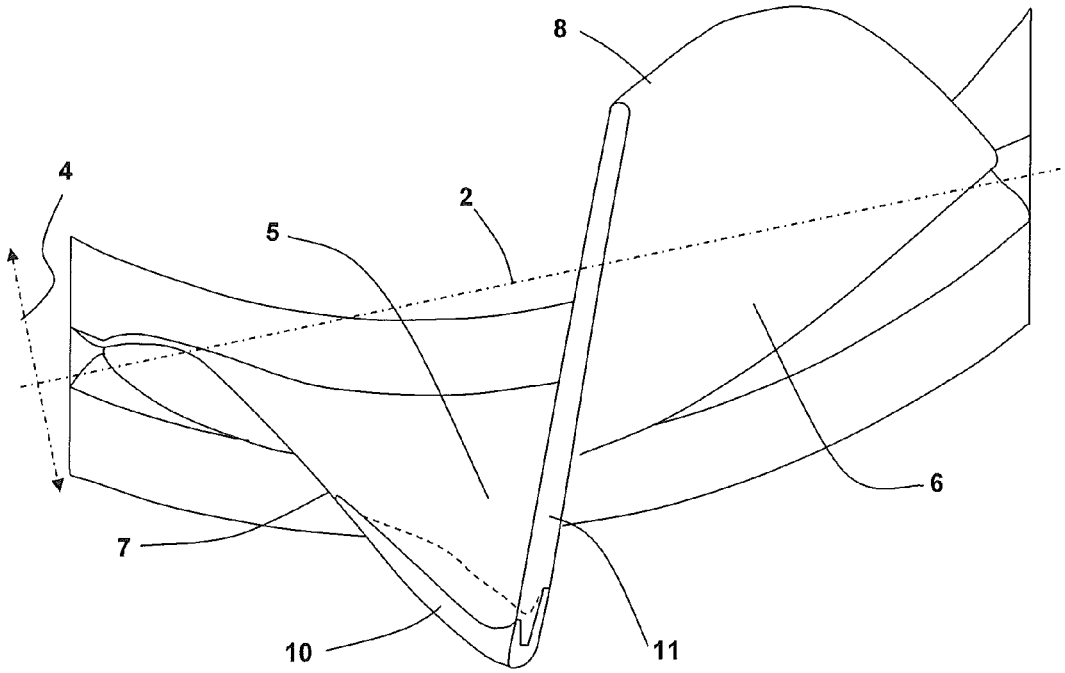
FIG. 1 is a top view of a blade according to an exemplary embodiment of the disclosure.

Exemplary embodiments of the present disclosure are now described with references to the drawings, wherein like reference numerals are used to refer to like elements throughout. In the following description, for purposes of explanation, numerous specific details are set forth to provide a thorough understanding of the disclosure. However, the present disclosure may be practiced without these specific details, and is not limited to the exemplary embodiments disclosed herein.

An exemplary embodiment shown in FIG. 1 is a rotating blade that is configured and arranged to rotate around a rotational axis 2, which in the radial direction forms a longitudinal plain. The blade comprises a leading edge 7, trailing edge 8 a pressure surface 5 and a suction surface 6. The leading edge 7 is curved along a radial height 3 in a circumferential direction 4 relative to the rotational axis 2, and additionally comprises a sheath 10 that covers a portion of the core 11 of the blade and forms at least a portion of the leading edge 7.

In a not shown exemplary embodiment, a blade comprises a sheath 10 that covers a portion of the core 11 of the blade and forms at least a portion of a curved trailing edge 8 of the blade wherein the curvature is along a radial height 3 of the blade in a circumferential direction 4.

In order to assist bonding of the sheath 10 to the edge 7, 8, it is advantageous to increase the surface area of contact between the sheath 10 and the body of the blade. This is achieved by the sheath 10 including a suction portion 22 and a pressure portion 12 that each project from a head portion 20 of the blade so as to form part of the suction surface 6 and pressure surface 5 respectively. Even though erosion protection is primarily required on the suction surface of the blade, maximising the contact surface area of the sheath 10 on the pressure surface 5 maximises the adhesion surface between the sheath 10 and the body of the blade, which is enhanced by the inner surface of the pressure portion 12 and the inner surface of the suction portion 22 forming a cavity between themselves that is shaped to enable the insertion of a portion of the core 11 therein.

Figure 2:
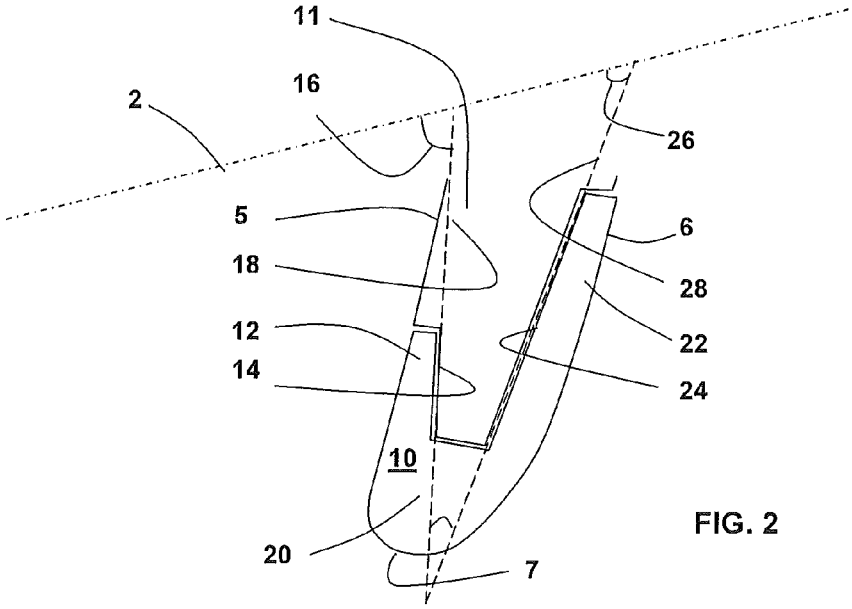
FIG. 2 is a sectional top view of a portion of the blade of FIG. 1 showing the angular alignment of inner surfaces of an exemplary sheath relative to an axis of rotation of the blade.
Figure 3:
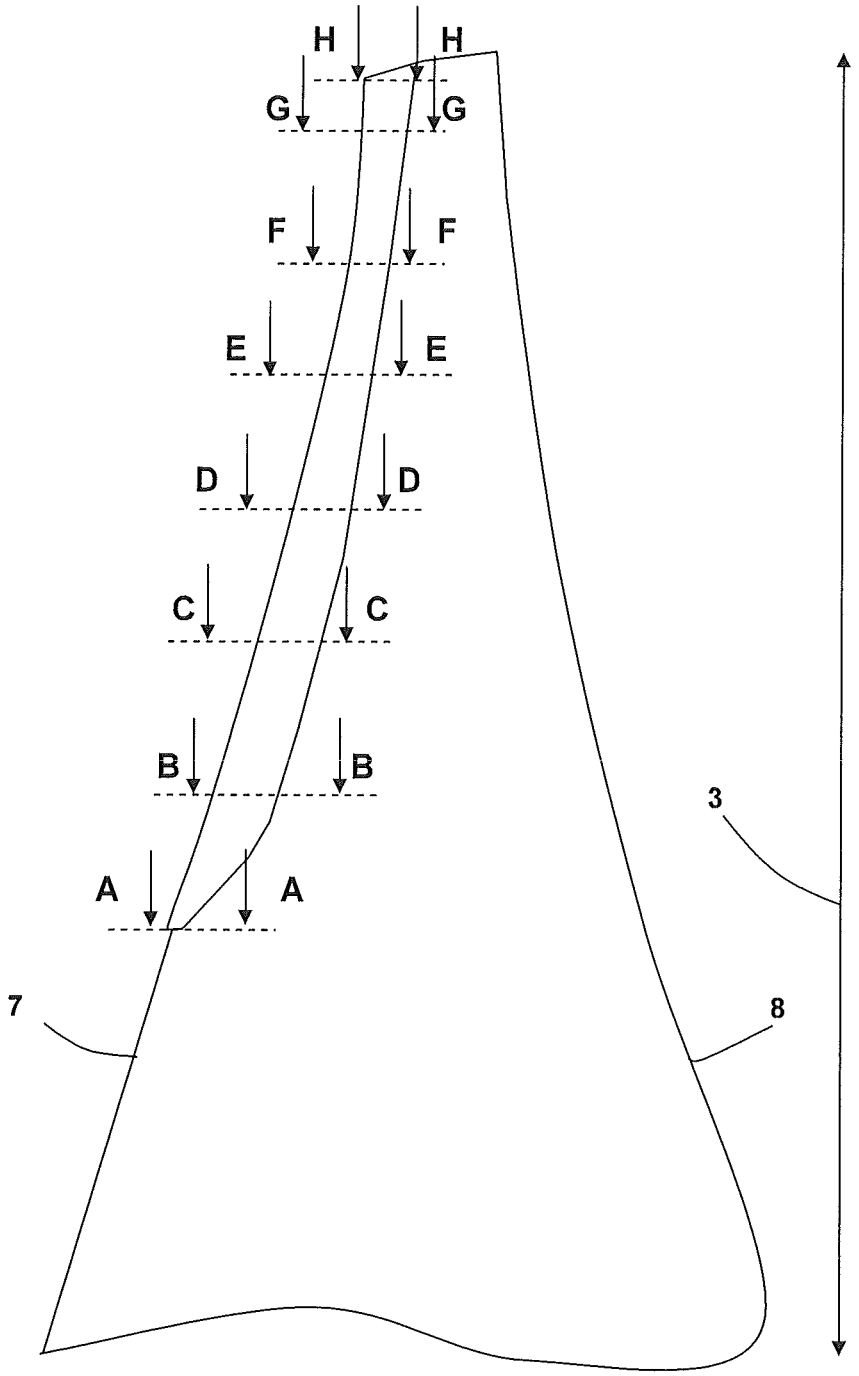
FIG. 3 is a side view of the blade of FIG. 1.

As shown in FIG. 2, the sheath 10 is configured to protect the blade body from erosion in a circumferential curved edge region of the blade by forming part of an edge 7, 8 region of the blade.

Figure 4:
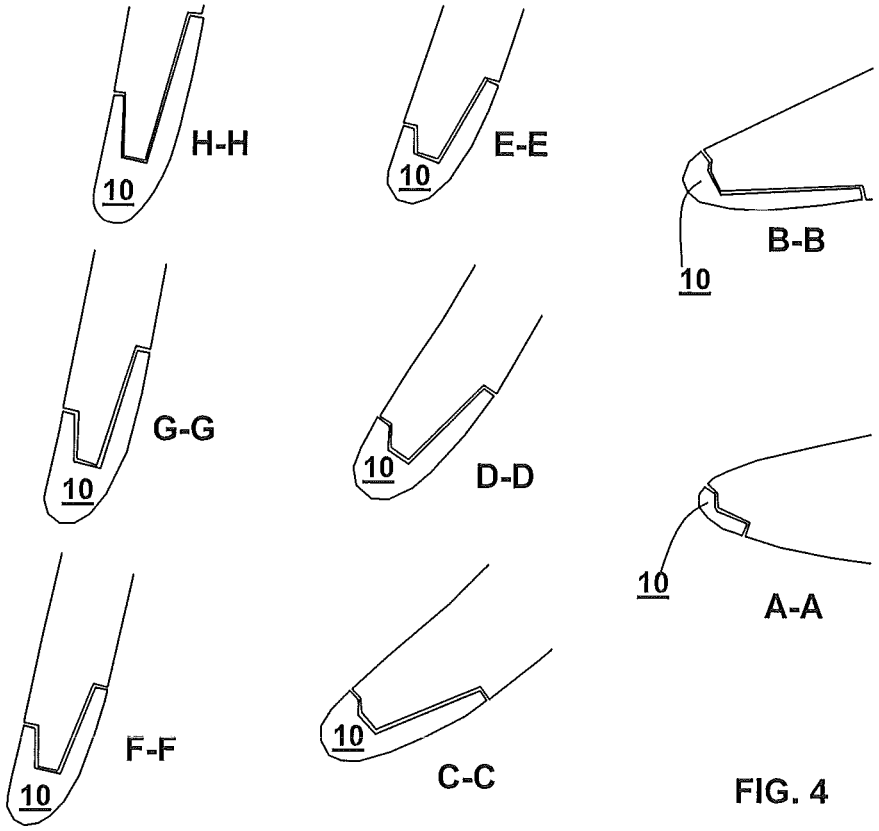
FIG. 4 are top view of partial axial sections shown in FIG. 3

In an exemplary embodiment shown in FIG. 2, to enable fitting of the sheath 10 as a single piece to the curved edge 7, the sheath 10 is configured such that the sheath 10 has a fixed assembly angle on the core 11 over the radial height 3 of the sheath 10. In an exemplary embodiment, this is achieved by the pressure inner surface 14 of the pressure portion 12 of the sheath 10 being configured such that at any circumferential section of the blade, a tangential vector 18 projected from any point of the pressure inner surface 14 forms a first angle 16 with the rotational axis 2. This first angle 16 does not vary over the radial height 3 of the sheath 10. That is, the first angle 16 is uniform over the entire radial height 3 of the sheath 10. When the pressure inner surface 14 is in each circumferential cross section forms a flat plain, the first angle 16 is the assembly angle 16 and as a result defines the assembly direction of the sheath 10 on the core 11. As a result of the fixing of the first angle 16, as can be seen in FIG. 4 the length of the pressure portion 12 varies with radial height 3 due to the curvature of the blade resulting in a change in angle of the pressure surface 5 relative to the rotational axis 2.

To further enable the fixed assembly angle despite the curvature of the edge 7, 8 the suction inner surface 24 extends from the head portion 20 either parallel to or divergent from the pressure side inner surface 14. When diverging, a tangential vector 28 to the suction inner surface 24 forms a second angle 26 with the tangent line 18 of the pressure inner surface 14. In this embodiment, the suction inner surface 24 may be either straight or curved.

As long there is no point of convergence between the two tangent lines 18, 28 and there is a fixed angle 16 at either the pressure inner surface 14 or the suction inner surface 24, it is possible to have a fixed assembly direction along the entire radial height 3 of the sheath 10, thus enabling the fitting of a ridged, inflexible sheath 10 to a curved edge of a blade as a single piece.

Although the disclosure has been herein shown and described in what is conceived to be the most practical exemplary embodiments, the present disclosure can be embodied in other specific forms. For example, while illustrated embodiments shows the application of a sheath 10 to the leading edge of a blade, the invention may be equally applied using the described exemplary embodiments, to the trailing edge of the blade. Alternatively, although exemplary embodiments provide that the pressure inner surface 14 has a fixed first angle 16, the fixed suction inner surface 24 may alternatively have the fixed angle rather or in addition to the pressure inner surface 14. Yet further, although the pressure inner surface 14 is shown for each circumferential cross-section to be straight, it is possible to provide the inner surface 14 with an outwardly flaring inner surface in which one point of the pressure inner surface 14 defines the assemble angle 16. The presently disclosed embodiments are therefore considered in all respects to be illustrative and not restricted. The scope of the disclosure is indicated by the appended claims rather that the foregoing description and all changes that come within the meaning and range and equivalences thereof are intended to be embraced therein.

The invention claimed is:

1. A rotating blade having:

a rotational axis defining a circumferential direction that is concentric to the rotational axis a first surface;

a second surface diametrically opposed the first surface;

an curved edge, defined by a junction, in a radial direction, between the first surface and the second surface, wherein the curved edge is curved from the radial direction in the circumferential direction;

a core defining the basic shape of the rotating blade a sheath covering a section of the core so as to form a portion of the first surface, the second surface and the curved edge, the sheath comprising:

a first radial end;

a second radial end radially distal from the first radial end;

a head portion forming the portion of the curved edge between the first radial end and the second radial end;

a first portion, extending from the head portion to form a portion of the first surface, having a first inner surface facing the core; and a second portion, extending from the head portion to form a portion of the second surface, having a second inner surface that faces the core, wherein the orientation of the first surface and the second surface relative to each other is such that over the radial height of the sheath, the sheath has a fixed assembly angle on the core.

2. The rotating blade of claim 1, wherein the rotational axis defines a longitudinal plain extending radially from the rotating axis and the fixed assembly direction is a result of the first inner surface being such that at any circumferential cross section a first tangential vector, the first inner surface forms a fixed first angle with the longitudinal plain while at the same circumferential cross section the extension of the second inner surface from the head portion the second inner surface remains constant and/or diverges from the first inner surface.

3. The rotating blade of claim 1, wherein the first inner surface, in any circumferential section between the radial first end and the second radial end, is essential straight.

4. The rotating blade of claim 1, wherein the curved edge is a leading edge.

5. The rotating blade of claim 1, wherein the first surface is a pressure surface of the blade and the second surface is a suction surface of the blade.

6. The rotating blade of claim 1, wherein the first surface is a suction surface of the blade and the second surface is a pressure surface of the rotating blade.

* * * * *